US005127658A

United States Patent [19]

Openiano

[11] Patent Number: 5,127,658

[45] Date of Patent: Jul. 7, 1992

[54] REMOTELY-CONTROLLED LIGHT-BEAM FIRING AND SENSING VEHICULAR TOY

[76] Inventor: Renato M. Openiano, P.O. Box 45156, San Diego, Calif. 92145

[21] Appl. No.: 576,220

[22] Filed: Aug. 30, 1990

Related U.S. Application Data

[63] Continuation-in-part of Ser. No. 444,800, Dec. 1, 1989, abandoned.

[51] Int. Cl.[5] ..... A63H 30/04

[52] U.S. Cl. ..... 273/311; 273/312; 446/7; 446/130; 446/456

[58] Field of Search ..... 273/311, 312, 310; 446/7, 130, 230, 454, 456, 484

[56] References Cited

U.S. PATENT DOCUMENTS

| | | | |
|---|---|---|---|
| 2,562,648 | 7/1951 | Sparrow | 273/311 |
| 3,101,569 | 8/1963 | Giardina | 446/454 |
| 3,202,425 | 8/1965 | Van Hennik | 273/312 |
| 4,695,266 | 9/1987 | Hui | 446/454 |
| 4,844,474 | 7/1989 | Schaub et al. | 273/310 |
| 4,932,913 | 6/1990 | Raviv et al. | 446/7 |
| 4,938,483 | 7/1990 | Yavetz | 273/311 |

*Primary Examiner*—Benjamin Layno
*Attorney, Agent, or Firm*—William C. Fuess

[57] ABSTRACT

Each of a plurality of toy vehicles is remotely-controllable by a single associated remote controller for movement, and for the emission of a directed light beam in simulation of gunfire. Each vehicle is sensitive to the directionally emitted light beams, or simulated gunfire, of other vehicles. Such sensitivity is normally sequentially periodic in quadrants circumferentially around the vehicle, providing an element of randomness, and timing, to the registration of simulated hits from the simulated gunfire of opposing vehicles. The vehicle indicates the number of successive hits sustained, and after a predetermined number, nominally three, such hits becomes disabled until manually reset. Two such vehicles, each under the individual control of an associated remote controller, may be used to simulate combat during war gaming.

18 Claims, 7 Drawing Sheets

REMOTELY-CONTROLLED LIGHT-BEAM FIRING AND SENSING VEHICULAR TOY

REFERENCE TO RELATED PATENT APPLICATIONS

The present application is a continuation-in-part copending U.S. patent application Ser. No. 444,800 to the self-same inventor as the inventor of the present patent application.

BACKGROUND OF THE INVENTION

1. Field of the Invention

The present invention related to (i) a remotely-controlled vehicular toy, (ii) a positionally-sensitive control device usable as part of a remote-controller for providing positional control signals to remotely-controlled toys, and (iii) a gaming system based on a plurality of remotely-controlled vehicular toys that both emit, and sense, light beams.

2. Background of the Invention 2.1 Remotely-Controlled Vehicular Toys

Various remotely-controlled vehicular toys area currently commercially available (circa 1990). Some of these remotely-controlled vehicular toys are usable in play to simulate warfare, such as by charging into obstacles or other toys, or by firing toy projectiles.

An effective war gaming system using a plurality of remotely-controlled vehicular toys would preferably use toy vehicles that are not only remotely-controlled for maneuvering, and to simulate the fire of armament, but which are, additionally, sensitive to the armament fire of other, competing toys in order to determine which toy, and toy operator, emerges the "victor" in a simulated battle. Because the armament fire of actual military vehicles, such as tanks, is directional, and only occasionally effective to disable another real vehicle (for example, another actual tank at which the armament is fired), it would be useful if the toy vehicles could support some sustained form of war gaming play, and could be able to take more than one "hit" before becoming disabled. Just as the progressive degradation and disablement or real armaments is visually observable during the course of a battle, it would further be useful if a remotely-controlled vehicular toy used in war gaming could visually indicate each individual "hit" and/or the total accumulated "hits." The vehicular toy would desirably simulate disablement after the accumulation of a sufficient number of such "hits."

2.2 General Directional Control Mechanisms

Similarly to the present availability of various remotely-controlled vehicular toys, there exist diverse manually-activated directional control mechanisms. These mechanisms sometimes serve as component parts of a remote controlled transmitter. They permit directional commands, and other commands such as commands directing the firing of armament, to be generated. One common such directional control mechanism is called a joystick.

It would be desirable if a control mechanism that is similar to the actual control mechanism of a military vehicle or helicopter could be used in conjunction with a remotely-controlled vehicular toy used in way gaming. Such as remote control mechanism would be desirably be full-floating, meaning that a left or right steering control could be affected by turning a steering wheel (or other hand grip) either to the left or to the right, while a forward and back directional control would be accomplished by tilting the steering wheel either forward or backward. Such a multi-axis directional control might desirably be coupled with trigger mechanisms, or other switching devices, mounted to the steering wheel (or other hand grip) so that secondary control signals could be generated with the fingers even while one or both hands were otherwise engaged in commanding the spatial movement of the remotely-controlled vehicular toy.

2.3 A Specific Previous Tilt-Detecting Mechanism

The positionally-sensitive directional-signal-generating control device in accordance with the present invention will be seen be sensitive to spatial orientation in order to provide directional signals similar to those that might otherwise be generated by a joystick. A previous mechanism that is sensitive to tilt in fore-and-aft, and side-to-side, axis in order to generate electrical signals is shown in U.S. Pat. No. 4,925,189 for a Body-Mounted Video Game Exercise Device to Braeunig. Braeunig's positional controller attaches to the user's upper back with an arrangement of straps and buckles. The tilt of the user's upper body is detected by an array of mercury switches, with resultant electrical signals being transmitted by wire to the input of a video game. The specific angle of tilt required to actuate the mercury switches can be adjustable, thereby varying the degree of upper body movement needed to play a particular video game. Additional controls for the video game, such as a firing control, are provided by a hand-held push button attached to the controller via a flexible cord.

Such a previous spatial control mechanism is both (i) limited in its permissible spatial orientation during use, and (ii) tethered by wires to a device, namely a video game, that uses the positional electrical signals generated by the spatial control mechanism.

SUMMARY OF THE INVENTION

The present invention contemplates a vehicular toy that both (i) spatially maneuvers, and (ii) fires a simulated "gun" or "cannon"—normally a directionally-emitted concentrated light beam—at equivalent, adversary, toys under remote control. Each toy (iii) detects the simulated "gunfire," or concentrated directional light beam, of other such toys, and is (iv) selectively sensitive in time and/or spatial direction in such detections, making that not all light beam that variously impinge upon the toy invariably score "hits." Each vehicular toy indicates, normally visually, each occasion when it has been successfully "hit" by the simulated "gunfire" of opposing toys. When the accumulation of such simulated "hits" is sufficiently great then the toy stops, simulating disablement or destruction, until manually reset.

The present invention further contemplates a spatially full-floating multi-directional control mechanism having a handle grip that is typically in the shape of at least an arcuate portion of a steering wheel. When held by one or two hands and positionally oriented in free space, the mechanism produces signals indicating both left and right, and forwards and rearwards, depending on its (i) orientation and (ii) acceleration. When such a mechanism incorporated within a remote control transmitter and used to control the remotely-controlled locomoting toy in accordance with the present invention, it permits a highly responsive, sensitive and dynamic directional control of the toy.

In its preferred embodiment, the remotely-controllable locomoting toy in accordance with the present invention includes a toy body, normally molded of plastic. A receiver, mounted to the toy body, receives remotely-generated commands from an associated remote controller. A self-energized source of motive force, normally a battery and a motor, is also mounted to the toy body. The source of motive force is responsive to selected commands decoded by the receiver so as to cause the toy body to move about, normally on the floor or ground. A steering activator, typically a solenoid, is connected through steering gear to turnable wheels that are rotatably mounted to the toy body, and is powered by the battery. The steering activator is also responsive to selected commands decoded by the receiver so as to impart directional control to the toy body during its movement.

A directional signal-emitting means, normally a light-emitting diode emitting a light beam that is concentrated and collimated in a lens and which passes through a tube, emits a directional signal in response to receipt of selected remotely-generated commands.

In addition to the receiver of the remotely-generated commands, at least one other, second, receiver is mounted to the toy body. A preferred plurality of second receivers receive, at times, the directionally-emitted light signals that are emitted by other, equivalent, toys. The preferred plurality of second, light-signal-sensitive, receivers are normally circumferentially arrayed around the exterior of the toy body. Normally only one such second receiver can be impinged upon by any single externally-emitted light beam at any one time.

In accordance with the present invention, the spatially-arrayed plurality of second receivers, which are normally phototransistors, not continuously temporally enabled but are only selectively enabled, normally temporally periodically and rotationally in sequence. Each second receiver that is so selectively enabled preferably so visually indicates both the (i) times and (ii) durations of its enablement(s), normally by light emission from an associated, spatially proximate, light- emitting diode.

Responsive to each enabled receipt of a directional signal, or simulated "gunfire," of another toy, an incidence signal is produced. An indicator, normally one or more simple LEDs, is responsive to the incidence signal for producing a humanly perceptible indication that an event, or a "hit," has occurred. Two such remotely-controllable locomoting controllable locomoting and directional-signal emitting and directional-signal-sensitive toys may be used together in simulated war gaming.

The preferred embodiment toy preferably accumulates a number of simulated "hits" by (i) selectively receiving the directionally-emitted signals or light beams, of other toys, and (ii) indicating each such "hit" when received, before (iii) finally stopping in a disabled condition for further movement. A disabled toy may be reset, preferably by a manual switch.

Accordingly, a principal object of the present invention is to provide a remotely-controlled vehicular toy that simulates directional "gunfire," normally by emission of a concentrated light beam, at an adversary toy vehicle. Each vehicle includes a means of detecting the directional fire, or concentrated light beam, of another such toy.

Another object of the present invention is to provide in a remotely-controlled gunfire-simulating and simulated-gunfire-sensitive toy a means for counting, and indicating the numbers of, the times that such toy has been "hit" by simulated "gunfire." After a sufficient number of "hits" are accumulated the toy preferably simulates its own disablement, or destruction, by refusing to further respond to remote commands until reset.

A still further object of the present invention is to provide a remotely-controlled gunfire-simulating and simulated-gunfire-sensitive locomoting toy that presents a multiplicity of simulated-gunfire sensors, normally photo transistors, at different spatial positions, normally at positions circumferentially arranged around the body of the toy. Such sensors are only selectively temporally enabled, preferably in a rotational order. Only those particular one or more sensors that are currently enabled can detect, at any one time, the impingence of simulated "gunfire"—a directed light beam—originating from another, equivalent, toy. Only such simulated "gunfire," or directional light beam, as impinges upon a sensor that is selectively enabled will be registered by the receiving toy as constituting a "hit." In this manner, an element of skill is introduced into a simulated war gaming system because the remotely-controlled locomoting toys are both spatially controlled in position and orientation, and temporally controlled in the times of their emission of simulated "gunfire."

This object of the present invention that sensitivity of a toy to simulated "gunfire" should be selective is broad, and expressible in many other forms than just a periodic selective enablement for receiving opposing "gunfire" from different directions. Any of the (i) numbers, (ii) durations, (iii) directions, and/or (iv) angular (or solid angular) extent of the various enablements occurring at any one competing toy may be varied from the like parameters at another toy, providing a rudimentary form of handicapping. Certain locations on a toy may be less often enabled for the receipt of simulated "gunfire," or enabled for shorter periods of time—simulating that these locations are more heavily "armored." The selective enablements for the receipt of opposing "gunfire" may be adaptive, progressing in rotation either faster or slower, or more numerously or less numerously, as the toy accumulates successive "hits." Finally, other optional characteristics of the toy such as its mobility, speed, and/or ability to emit simulated "gunfire" may be conditioned upon the accumulation of successive "hits."

These and other aspects and attributes of the present invention will become increasingly clear upon reference to the following drawings and accompanying specification.

DETAILED DESCRIPTION OF THE INVENTION

Figure 1:
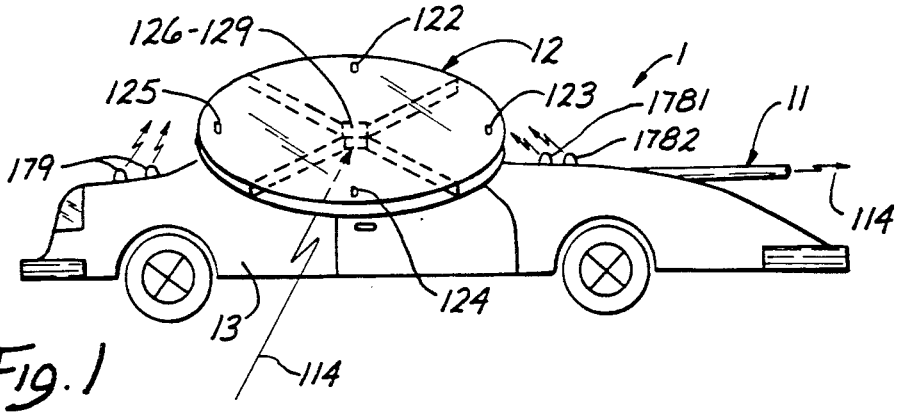
FIG. 1 is a diagrammatic view showing a preferred embodiment of a remotely-controlled vehicular toy, having a light beam emitter and a plurality of light beam detectors installed, in accordance with the present invention.

A remotely-controlled vehicular toy 1 in accordance with the present invention is diagrammatically shown in FIG. 1. A light beam emitter, or "gun," 11 emits a directed light beam. A hollow-core light beam detector assembly 12 is mounted to the vehicle body 13, and in turn mounts a plurality of indicators 122–125—normally Light Emitting Diode (LED) indicators—circumferentially around its exterior periphery. At its central core the light beam detector assembly 12 mounts a plurality of light detectors 126–129.

Figure 2:
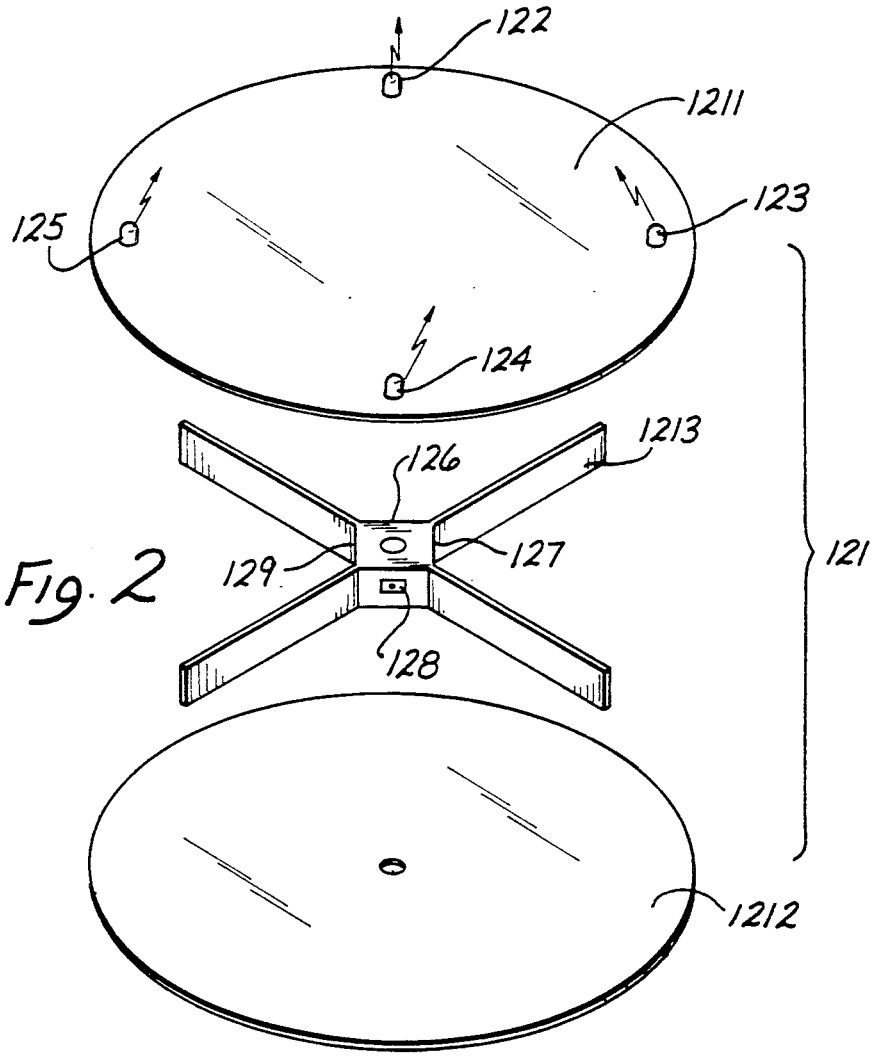
FIG. 2 is an exploded view of a light beam detector assembly that is used on the remotely-controlled vehicular toy in accordance with the present invention.

An exploded view of the light beam detector assembly 12 is shown in FIG. 2. A frame 121 consists of top disk 1211 separated from bottom disk 1212 by dividing and holding block 1213. The top disc 1211 supports the indicators 122–125. The dividing and holding block 1213 divides the hollow central core of the frame 121 into a plurality of angular segments, normally into quadrature. The apex of each such angular segment contains an associated light beam detector 126–129. Only a light beam 114 that is impingent upon the light beam detector assembly 12, and upon the vehicular toy 1, from an appropriate angle will be channeled by the light beam detector assembly 12 so as to be recognized by associated light beam detector 126–129.

Figure 3:
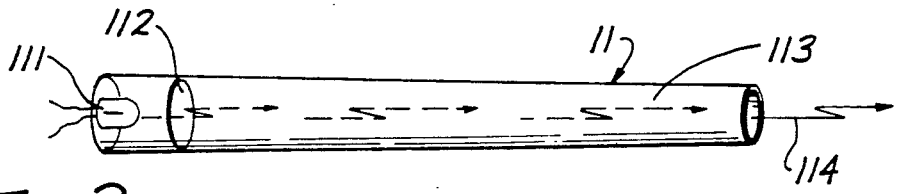
FIG. 3 is a cut-away view of a light beam emitter, or "gun," that is used on the remotely-controlled vehicular toy in accordance with the present invention.

An expanded view of a preferred embodiment of the light beam emitter, or "gun," 11 is shown in FIG. 3. Light emitted from a light source 111, normally a Light Emitting Diode (LED) is collimated by a lens 112. The lens 112 may be a plastic, glass, or graded index optics lens. The collimated light beam 114 is passed through a barrel, or tube, 113 to be emitted at its distal end. The light beam 114 is of sufficiently low intensity so as not to be injurious to the human eye, but can readily be detected by a light detector, or photo sensor, at a distance of at least several feet.

At some conveniently visible location the vehicular toy 1 mounts a first pair of Light Emitting Diodes 1781, 1782 that progressively light first one (LED 1781) and then together (LEDs 1781, 1782) as first one, and then two, "hits" are sustained. When a third "hit" is sustained then the vehicular toy 1 is disabled for movement, and the second pair of LED's 179 will flash continuously in unison. The selective indications of the LED's 1781, 1782 and 179 will be more completely shown in the schematic diagram of FIG. 10.

Figure 4:
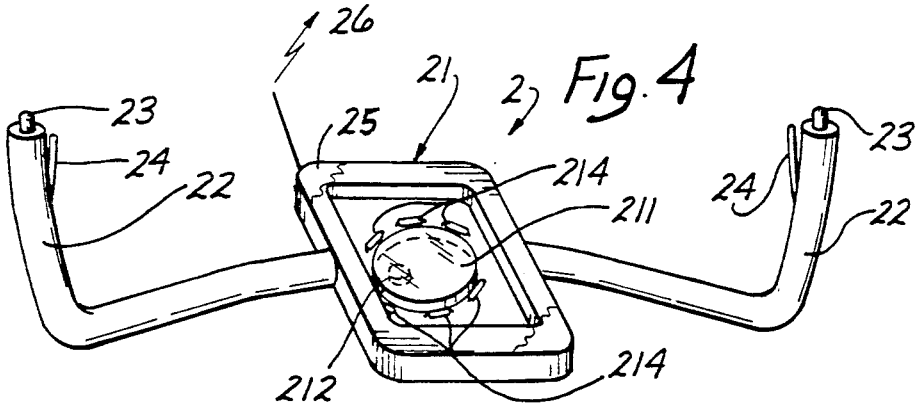
FIG. 4 is a cut-away perspective of a first embodiment of a full-floating simulated steering wheel remote control mechanism in accordance with the present invention.

Each one of the vehicular toys 1—and there may be several such toys in an interactive war gaming system in accordance with the present invention—is interoperative with an associated remote controller 2, as is diagrammatically illustrated in FIG. 4. The remote controller 2 includes a full-floating simulated steering wheel remote control mechanism 21. The mechanism 21 provides a member, or handlebar, or steering wheel 22 that is gripable by the hand. Thumb-operated push-button switches 23 and index-finger-operated trigger switches 24 provide signals to a remote control transmitter 25.

Figure 5:
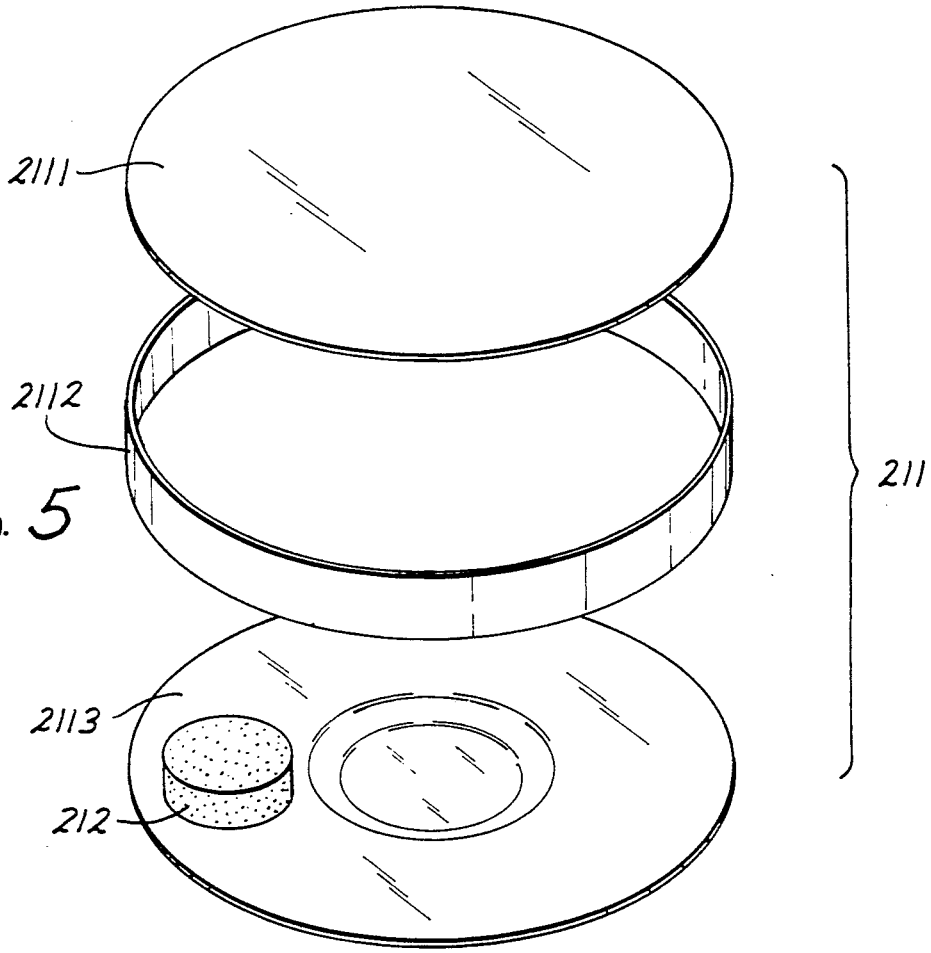
FIG. 5 is an exploded view of a main casing part used within the full-floating simulated steering wheel remote control mechanism shown in FIG. 4.
Figure 6:
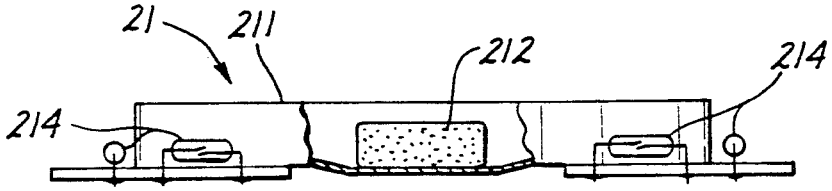
FIG. 6 is a cut-away front view of the main casing part previously shown in FIG. 5, and surrounding circuity, within the full-floating simulated steering wheel remote control mechanism shown in FIG. 4.

An exploded view of the casing 211 of a first embodiment of the full-floating simulated steering wheel remote control mechanism 21 is shown in FIG. 5. A side view, partially in cutaway, of the same first embodiment of the remote control assembly 21 is shown in FIG. 6. The casing 211 consists of a top cap 211 and a bottom cap 2113 separated by a cylindrical middle case 2112. The bottom cap 2113 is circular in shape, and has a central trough, or indentation. A permanent magnet 212 moves within the hollow casing 211 under force of gravity.

During the course of its movement, the permanent magnet 212 becomes positioned proximately to one or more of the REED SWITCHES 214 which circumferentially array the casing 211. The casing 211 is typically plastic, and the permanent magnet 212 serves to magnetically actuate any of the REED SWITCHES 214 relative to which it becomes proximate.

During operation of the remote controller 2, a manual holding and movement of the member, or handlebar or steering wheel 22, causes the casing 211 to assume different spatial positions, moving the magnet 212 contained therein under force of gravity. During such movement the magnet assumes positions proximate to one or more of the REED SWITCHES 214 which are circumferentially arrayed around the casing 211. Actuations of selected ones of these REED SWITCHES 214, as well as the thumb-operated push-button switches 23 and the index-finger-operated trigger switches 24, are sensed as switch actuations by remote controller 25. The remote controller 25 translates these actuations into transmitted remote control signals, normally radio signals 26, as is more completely shown in the schematic diagram of FIG. 7.

Figure 7:
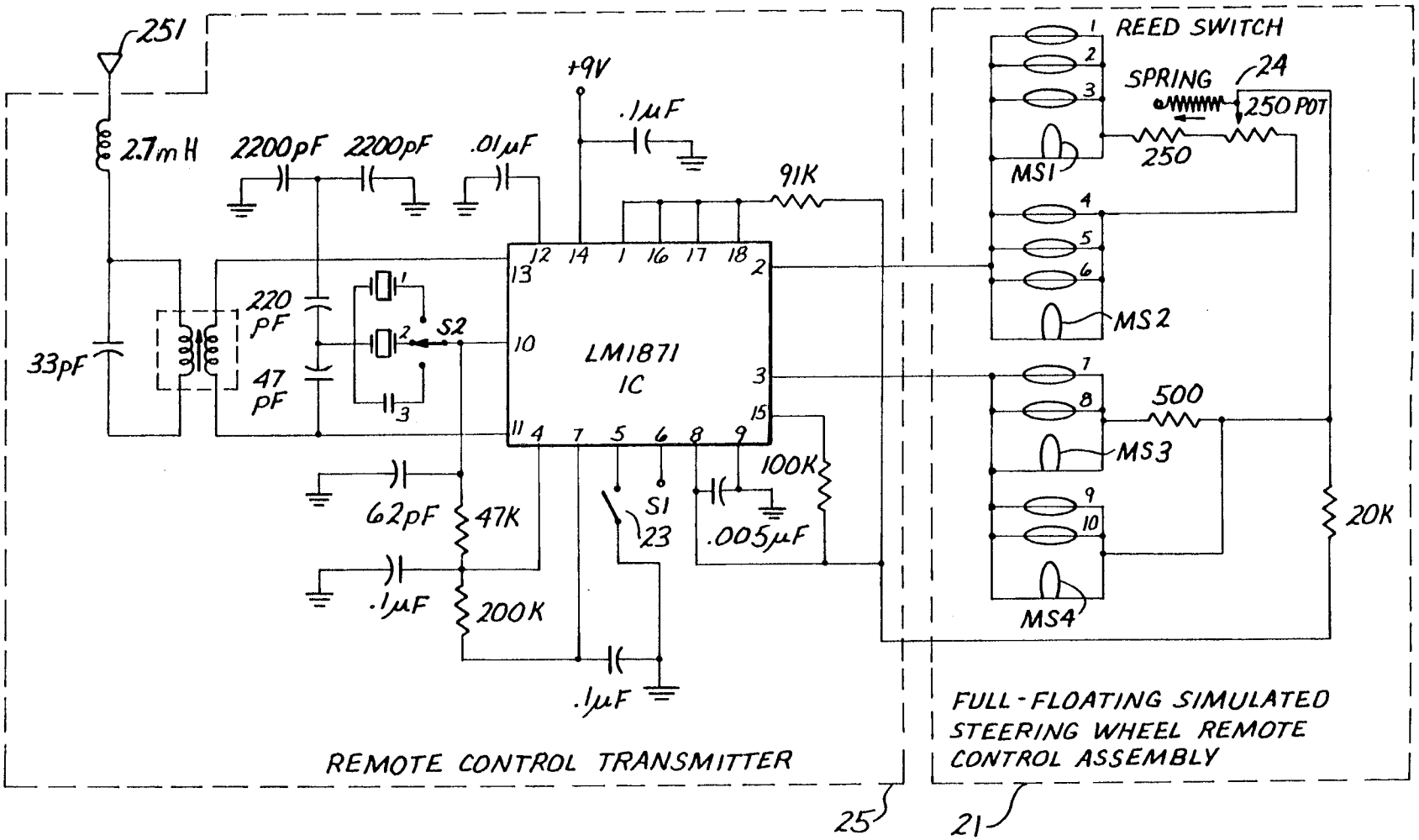
FIG. 7 is a schematic diagram of a transmitter used with the remotely-controlled vehicular toy previously shown in FIG. 1, and with the full-floating simulated steering wheel remote control mechanism shown in FIG. 4, in accordance with the present invention.
Figure 8:
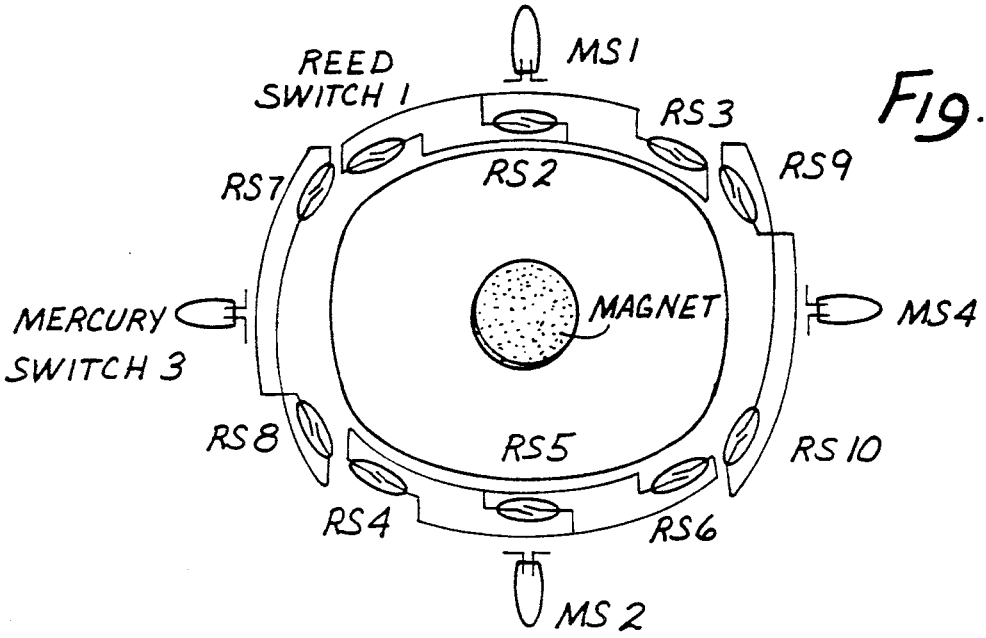
FIG. 8 is a diagrammatic representation of the spatial location of the reed switches, and of the mercury switches, that are shown within the schematic diagram of FIG. 7, and in the perspective view in FIG. 4, and which are within the full-floating simulated steering wheel remote control mechanism in accordance with the present invention.

The full-floating simulated steering wheel remote control mechanism 21, previously seen in FIG. 6, is shown in electrical schematic diagram at the right of FIG. 7, and in expanded diagrammatic illustration in FIG. 8. The remote control mechanism 21 preferably contains ten REED SWITCHES. The actuation of any one of REED SWITCHES 1–3 denotes that the control assembly is tilted forward, and that forward motion is commanded. The actuation of any one of REED SWITCHES 4–6 conversely denotes that reverse motion is commanded. The actuation of either of REED SWITCH 7 or 8 denotes that left motion is commanded, while the actuation of either REED SWITCH 9 or 10 denotes that right motion is commanded.

The spatial location of the ten REED SWITCHES in positions circumferentially around the periphery of casing 211 (previously seen in FIG. 6) is diagrammatically illustrated in FIG. 8. Note that the actuation of any one or ones of several different REED switches denotes that motion in that direction is commanded for example the actuation of any one(s) of REED SWITCHES 1–3 uniformly means that motion in a forward direction is commanded.

Figure 12:
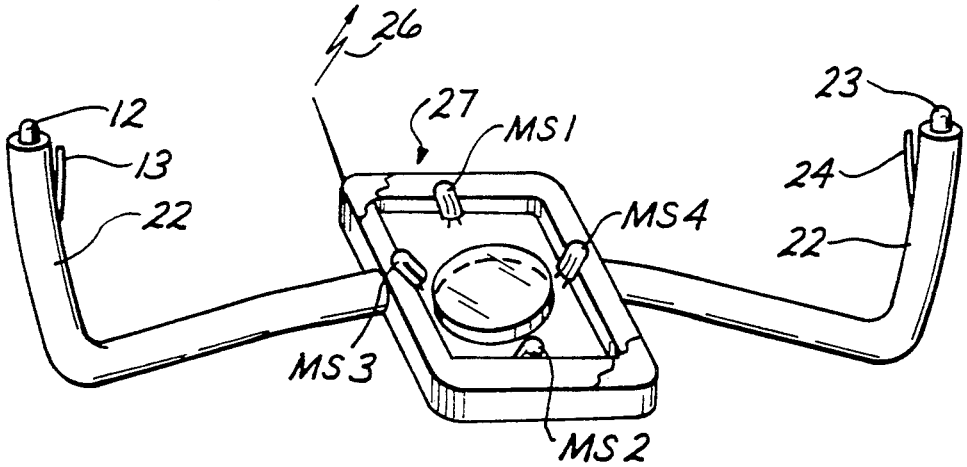
FIG. 12 is a diagrammatic representation of an alternative embodiment of the full-floating simulated steering wheel remote control mechanism in accordance with the present invention.

The entire remote control assembly 21 may alternatively be implemented with MERCURY SWITCHES MS1–MS4 which are shown in phantom line in the schematic diagram of FIG. 7. The physical location of such MERCURY SWITCHES is shown, again in phantom line, within diagrammatic FIG. 8. The optional MERCURY SWITCHES MS1–MS4 function equivalently to the preferred REED SWITCHES 1–10 to provide a path of electrical continuity when the casing 211 (shown in FIG. 6) is suitably positioned. In the eventuality that MERCURY SWITCHES are used, a magnet 212 moving within a hollow casing 211 is not required. A diagrammatic representation, similar to the representation of FIG. 4, of a remote control assembly 27 using MERCURY SWITCHES MS1–MS4 is shown in FIG. 12.

The index-finger-operated trigger switch 24 (which may, or may not, be considered to be part of remote control mechanism 21), and the thumb-operated push-button switch 23 (which likewise may, or may not, be considered to be part of the REMOTE CONTROL TRANSMITTER 24) are shown in the schematic diagram of FIG. 7. The selective actuations of all of the REED SWITCHES 1–10, the push-button switch 23, and/or the trigger switch 24, are sensed by the REMOTE CONTROL TRANSMITTER 25. The magnitude, and polarity, of these signals serve to encode a radio signal that is transmitted via antenna 251. The frequency of operation of the REMOTE CONTROL TRANSMITTER 25 is determined by a selection with switch 26 between crystals XTAL1, nominally of 45 megahertz, or crystal XTAL2, nominally of 27 megahertz. The switch 26 is normally a three-position switch, and a third crystal XTAL3, possessing an oscillation frequency other than 27 or 45 mhz, may optionally be included. The purpose of switch S2 is to permit that each of two or more remote controller 2 communicates upon an associated unique radio frequency, and issues commands to an associated vehicular toy 1, without interfering with the simultaneous transmission of commands from another remote controller 2, operating at another radio frequency, to its associated vehicular toy 1. The ability to operate a plurality of vehicular toys 1, each by an associated remote controller 2, is necessary in the use of the vehicular toys in an interactive gaming system in accordance with the present invention.

Figure 9:
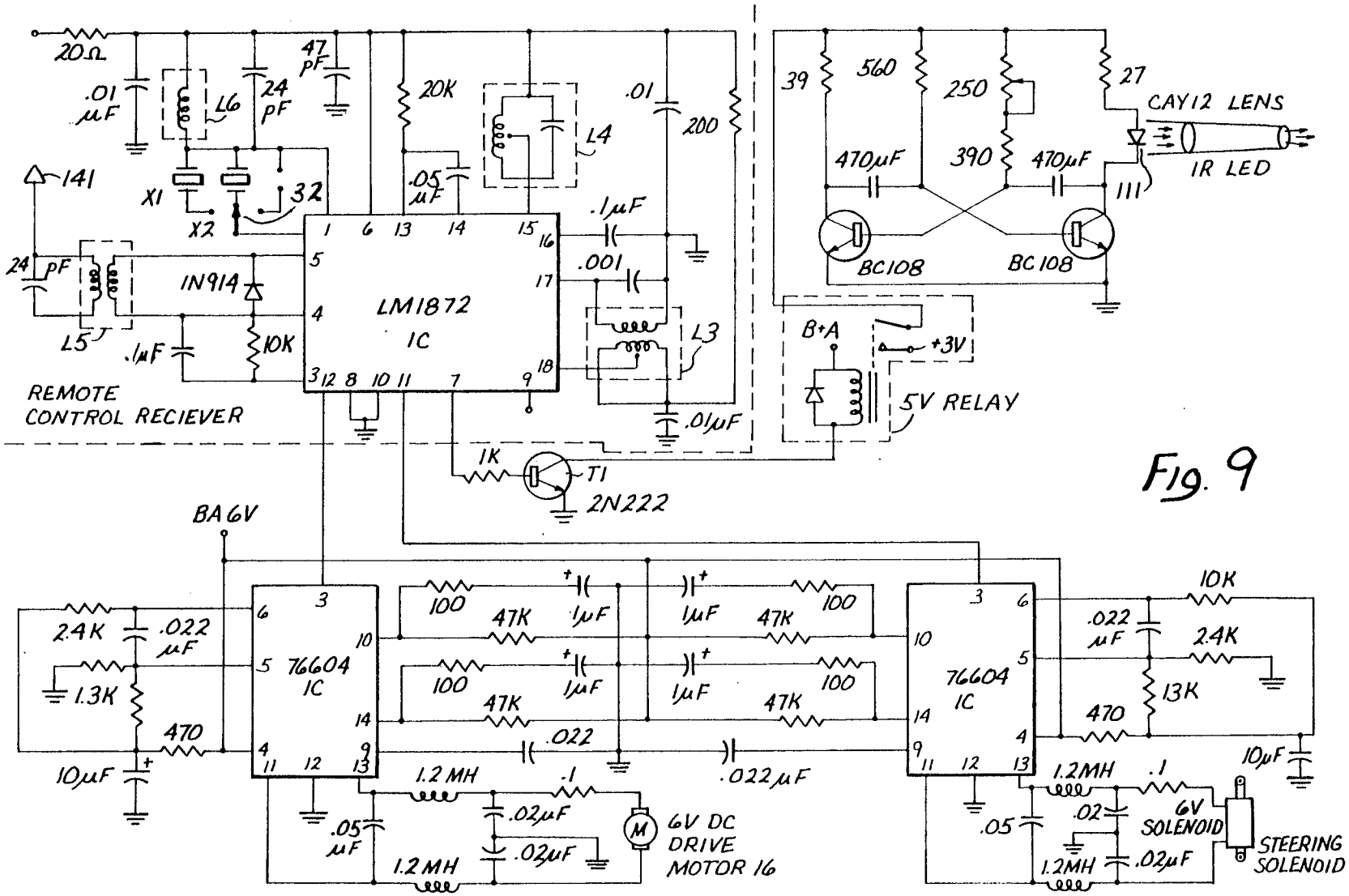
FIG. 9 is a schematic diagram of a receiver within the remotely-controlled vehicular toy, previously shown in FIG. 1, in accordance with the present invention.

A REMOTE CONTROL RECEIVER 3 suitable for use with REMOTE CONTROL TRANSMITTER 2, and certain electrical circuits and devices controlled by such receiver in implementation of the vehicular toy 1 in accordance with the present invention, are shown in FIG. 9. Both the REMOTE CONTROL TRANSMITTER 2 (shown in FIG. 7) and the REMOTE CONTROL RECEIVER 3 (shown in FIG. 9) are of conventional design. For example, such a remote control system is shown and described in the publication *First Book of Modern Electronics*, at Chapter 7, pp. 43–50.

A selected radio signal is decoded as received at antenna 31 a remote control receiver 3 in accordance with the selection by switch 32 alternatively between crystals X1, nominally of 27 megahertz, or X2, nominally of 45 megahertz. A third crystal X3, shown in phantom line, is optionally selectable by switch 32, establishing thereby an independent third channel of communication.

The decode of the received radio signals in integrated circuit receiver chip type LM1872 results in the generation of voltages of selected magnitudes, and polarities, on output pins 7, 11, and 12. The signal output on pin 7 is amplified in driver transistor T1 type 2N222 and used to actuate the coil of 5 V relay type RS275 243. Actuation of the 5 V relay permits a monostable multivibrator consisting of a pair of transistors type BC108 pk and associated circuitry to oscillate, providing an oscillating voltage to the infrared Light Emitting Diode (IR LED) 111. The light beam 114 emitted from IR LED 11 is communicated through lens 112, and down barrel 113, as is illustrated in FIG. 1 and FIG. 3. The firing of the light beam emitter, or "gun," 11 of vehicular toy 1 is thus remotely under the control of thumb-operated push-button switches 23 part of the remote controller 2 previously seen in FIG. 4.

In a similar manner, the signal produced at pin 11 of the integrated circuit type LM1872 of REMOTE CONTROL RECEIVER 3 is used, via a first integrated circuit driver type 76604, to actuate a six-volt STEERING SOLENOID 15. Dependent on the polarity of the signal produced at pin 11, the SOLENOID 15 may be caused to pull right or to pull left. Accordingly steering of the vehicular toy 1, is in accordance with the signals developed at remote controller 2.

Similarly, the signal produced at pin 12 of receiver integrated circuit type LN1872 of REMOTE CONTROL RECEIVER 3 is used, through power interface integrated circuit type 76604, to produce a 2-polarity, variable magnitude, drive signal to 6 VDC drive motor 16. In accordance with this signal, locomoting power will be provided to vehicular toy 1 in accordance with both (i) the forward and reverse directional signals developed by remote control assembly 21, and (ii) the speed control signals developed by index-finger-operated trigger switches 24, both of which are within remote controller 2 (all shown in FIG. 4 and 7).

Figure 10:
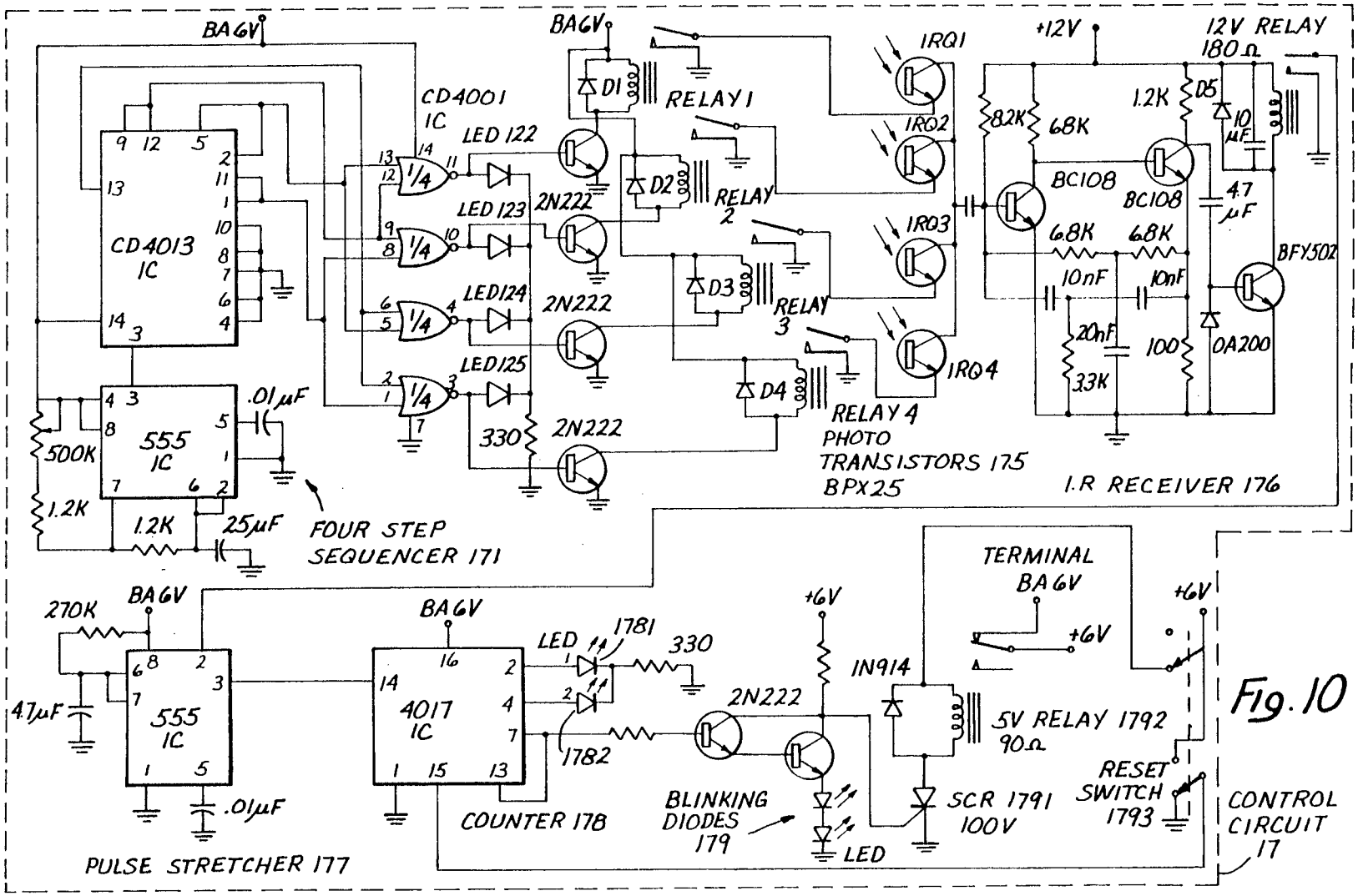
FIG. 10 is a schematic diagram of a light beam receiver, and of a control circuit, within the remotely-controlled vehicular toy, previously shown in FIG. 1, in accordance with the present invention.

A schematic diagram of the control circuit for implementation of a games-playing function using vehicular toy 1 in accordance with the present invention is shown in FIG. 10. Commencing at the upper left, a four-step sequencer based on integrated circuit clock timer type 555 and integrated circuit counter type CD413 produced stepwise incrementing binary-coded output signals that are received at four NOR gates of integrated circuit type CD4001. Each of the NOR gates will be sequentially enabled, producing a corresponding low output signal which both lights a corresponding one of the Light Emitting Diodes LED122–126, and enables the base of a corresponding switching transistor type 2N222. The Light Emitting Diodes LED 122–125, previously shown in FIG. 1, indicate that the vehicular toy 1 is enabled to receive a non-self-originated light signal at an associated quadrant. The numbers of the LEDs, and the numbers of angular positions from which light signals can selectively be received, may be other than in quadrature, in other than in the substantially horizontal plane.

The actuation of an associated switching transistor 2N222 to an individual one of the Light Emitting Diodes LED 122–124 closes an associated relay REL1-REL4, enabling an associated one of PHOTO TRANSISTORS IRQ1-IRQ4 type EXP 25. Receipt of appropriate frequency, infrared, light radiation during, and only during, the selective actuation of any one of the PHOTO TRANSISTORS IRQ1-IRQ4 will trigger the Darlington configuration amplifier of the IR RECEIVER 176, causing a momentary closure of 12-volt relay 1761.

In the preferred electrical embodiment of control circuit 17, the momentary electrical signal result from the momentary actuation of 12 V relay 1761 is shaped, and stretched, in PULSE STRETCHER 177. The important purpose of PULSE STRETCHER 177 is to provide that one only "hit," or receipt of a light signal, will be recorded during a singled, momentary, instance of play, and simulated gaming, between vehicular toys 1. In particular, it is not desirable that, should a single one of the PHOTO TRANSISTORS 175 be subject to a prolonged exposure to a light beam, more than one "hit" should be recorded from a single exposure event. The PULSE STRETCHER 177 substantially prevents double "hits," and assures that each successful instance of fire resulting in a "hit" upon the sensor PHOTO TRANSISTORS 175 of an opposing vehicular toy 1 results in the registration of one only "hit" at such toy.

Such registration of successive "hits" is accomplished in counter 178, which is nominally strapped by connection of appropriate pins so as to count three events, or "hits," successively lighting "hit" indicator LED 1 for a first such "hit," and then both LEDs 1,2 for a second such "hit," before producing, upon the third hit, an output signal to BLINKING DIODES 179. Actuation of the BLINKING DIODES 179 also activates silicon controlled rectifier SCR1791, closing 5 V relay 1792 and disconnecting the plus 6 V battery power supply from the distribution voltage bus BA6V. It may be noted that the four-step sequencer 171, NOR gates 172, the SWITCH TRANSISTORS 173, the RELAYS 174, the PHOTOTRANSISTORS 175, the PULSE STRETCHER 177, the COUNTER 178, and the other system components are each powered by the 6-volt distribution bus BA6V. Accordingly, disconnection of this bus means that the vehicular toy 1 is unpowered, with only the BLINKING DIODES 179 activated.

In order to reset the toy, and to recommence game playing, the RESET SWITCH 1793 is manually actuated, momentarily breaking the power to 5B RELAY 1792 and allowing the BUS 6 V battery power to be reconnected to the DISTRIBUTION BUS BA6V. Simultaneously, the two-poled double throw (2P2T) RESET SWITCH 1793 provides a reset signal to COUNTER 178, resetting the count to zero. Upon this occurrence, the vehicular toy 1 is re-enabled for use in play, and for simulated war gaming.

Figure 11:
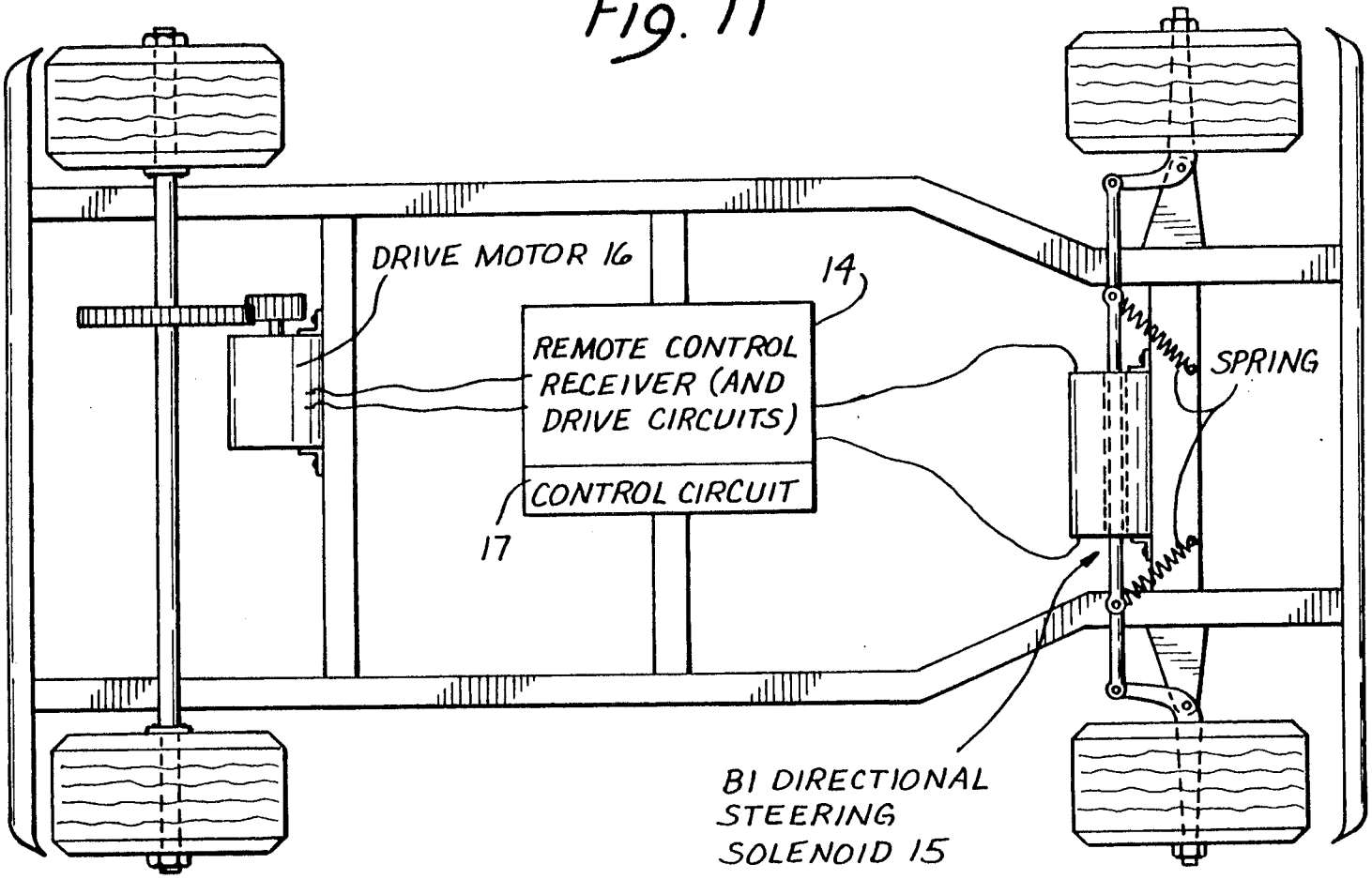
FIG. 11 is a mechanical schematic diagram of preferred drive, and steering, mechanisms within the remotely-controlled vehicular toy, previously shown in FIG. 1, in accordance with the present invention.

A mechanical schematic diagram showing a preferred layout of the chassis of the vehicular toy 1 in accordance with the present invention (previously seen in FIG. 1) is shown in FIG. 11. The remote control receiver and drive circuits (previously seen in FIG. 9) connect to the BI-DIRECTIONAL STEERING SOLENOID 15, and to the drive motor 16, respectively for the steering control, and the propulsion drive, of the vehicular toy 1. The CONTROL CIRCUIT 17, which is normally laid out on the same printed circuit board, and which is powered from the same battery power source (not shown) connects via wires (not shown), to PHOTO TRANSISTORS 126–129, to Light Emitting Diodes 122–125, and to hit status diodes 1781, 1782 and to BLINKING DIODES 179 (all shown in FIG. 1).

An alternative embodiment of a full-floating simulated steering wheel control mechanism 27 using mercury switches, as opposed to REED SWITCHES 1–10, is shown in mechanical schematic diagram in FIG. 12. The MERCURY SWITCHES MS1–MS4 are preferably mounted at about a 45° inclination to their common plane in order that one only such SWITCH may be actuated as the control mechanism is tilted either forward or backward, or right or left. Indeed, the SWITCHES may be empirically tilted so that each one just actuates as the opposed one deactuates during movement or acceleration of the steering wheel control mechanism 27.

In accordance with the preceding explanation, certain alterations and adaptations of the present invention will suggest themselves to a practitioner of the electrical and electronic design arts. For example, the sensitivity of the vehicular toy 1 to being hit by simulated "gunfire" from an opposing toy need not be regularly periodically sequential in time nor progressive in spatial angle, but could be non-periodic, or random, in both space and/or time. The sensitivity of a vehicular toy to successive hits could be either increased, or diminished, after the accumulation of prior "hits," thereby simulating a warring vehicle that becomes either degraded in performance or increasingly sensitive to further damage. The vehicle may be affected in its locomoting performance as successive levels of "damage" are sustained. The vehicular toys 1 may incorporate additional mechanical features suitable to war gaming play, such as breakaway gun barrels, or tubes, 113 that can be temporarily dislodged, or displaced, by ramming.

In accordance with these and other possible variants of a vehicular toy, and the gaming system enabled thereby, in accordance with the present invention, the invention should be interpreted in accordance with the following claims, only, and not solely in accordance with that particular embodiment within which it has been taught.

What is claimed is:

1. A remotely-controllable locomoting toy for use with an associated remote controller than generates commands, the toy comprising:

a toy body;

a receiver means, mounted to the body, for receiving remotely-generated commands from the associated remote controller;

a locomotion means, mounted to the body, responsive to selected ones of the received commands for causing the toy body to move about;

a directional signal-emitting means, mounted to the toy body, for directionally emitting a light beam signal in response to another selected one of the received commands;

a plurality of directionally-arrayed light detectors, mounted to the toy body, each for receiving at times a non-self-originated directionally-emitted light beam signal only from a particular spatial direction relative to the toy body, such received non-self-originated light beam signal corresponding to the self-originated directionally-emitted signal, and, responsive to each incidence of so receiving, for producing an incidence signal; and selective enablement means for selectively enabling each of the plurality of directionally-arrayed light detectors to produce, upon such times as the non-self-originated light beam signal is received from the particular direction, the incidence signal; and an indication means, responsive to the incidence signal, for producing an indication that the non-self-originated directionally-emitted corresponding signal was received;

wherein the times of receiving the one or more non-self-originated directionally-emitted light beam signals are substantially only when (i) the toy body and at least one of the plurality of directionally-arrayed light beam detectors mounted thereto are spatially within a path of a directional signal that is elsewhere originated, (ii) the at least one of the plurality of light beam detectors that is spatially within the path of the elsewhere-originated light beam signal is directionally oriented towards this signal, and (ii) the at least one of the plurality of light beam detectors that is spatially within the path of the elsewhere-originated light beam signal and that is directionally oriented towards this signal is selectively enabled;

wherein two such remotely-controllable locomoting toys can be used together in play with each being independently controlled by its associated remote controller to move about and to directionally emit a signal that is receivable, and indictable, by the other such toy upon such times as a detector upon the other toy is (i) within the path of the directionally-emitted signal, (ii) appropriately spatially oriented, and (iii) enabled.

2. A remotely-controllable locomoting toy for use with an associated remote controller that generates commands, the toy comprising:

a toy body;

a receiver means, mounted to the body, for receiving remotely-generated commands from the associated remote controller;

a locomotion means, mounted to the body, responsive to selected ones of the received commands for causing the toy body to move about;

a plurality of directionally-arrayed light detectors, mounted to the toy body, each for receiving at times a non-self-originated directionally-emitted light beam signal only from a particular spatial direction relative to the toy body, such received non-self-originated light beam signal corresponding to the self-originated directionally-emitted signal, and, responsive to each incidence of so receiving, for producing an incidence signal;

cyclical selective enablement means for cyclically periodically selectively enabling each of the plurality of directionally-arrayed light detectors to produce, upon such times as the non-self-originated light beam signal is received from the particular direction, the incidence signal; and an indication means, responsive to the incidence signal, for producing an indication that the non-self-originated directionally-emitted corresponding signal was received;

wherein the times of receiving the one or more non-self-originated directionally-emitted light beam signals are substantially only when (i) the toy body and at least one of the plurality of directionally-arrayed light beam detectors mounted thereto are spatially with a path of a directional signal that is elsewhere originated, (ii) the at least one of the plurality of light beam detectors that is spatially within the path of the elsewhere-originated light beam signal is directionally oriented towards this signal, and (iii) the at least one of the plurality of light beam detectors that is spatially within the path of the elsewhere-originated light beam signal and that is directionally oriented towards this signal is selectively enabled;

wherein two such remotely-controllable locomoting toys can be used together in play with each being independently controlled by its associated remote controller to move about and to directionally emit a signal that is receivable, and indictable, by the other such toy upon such times as a detector upon the other toy is (i) within the path of the directionally-emitted signal, (ii) appropriately spatially oriented, and (iii) enabled.

3. The toy according to claim 2 wherein the plurality of light detectors are substantially circumferentially arrayed around the toy body;

wherein the cyclical selective enablement means is cylically periodically selectively enabling the plurality of circumferentially-arrayed light detectors in order, one to the next.

4. The toy according to claim 2 further comprising:

display means for visually showing which of the plurality of light detectors is cyclically selectively enabled by the cyclical selective enablement means.

5. A remotely-controlled, toy, combat gaming system for use with a like system in order to simulate, by use of toy models, both (i) locomotion, and (ii) armament fire, of combat, the system comprising:

a remote controller manipulatable by a user for transmitting commands to an associated toy upon a dedicated channel that is unique among like remote controllers and among like toys;

a remotely-controllable toy, receiving remotely-transmitted commands from an associated remote controller, for, in selective response to received commands, (i) traveling and directionally orienting as commanded, and (ii) directionally emitting a signal as commanded in the manner of a beam, said signal being communicated on a universal channel that is in common with like toys, while (iii) detecting in a plurality of spatially-arrayed selectively-temporally-enable signal detectors a directionally-emitted signal not of its own origin while in the path thereof, while oriented so that a one of the plurality of detectors is directed towards the directionally-emitted signal for interception thereof, and while, and only upon such times as, the signal-intercepting one of the plurality of detectors is selectively enabled, and (iv) providing an indication in response to one or more detections of the directionally-emitted signal that is not of its own origin;

wherein an uncertainty that the remotely-controllable toy will detect a signal that is incident thereon, which uncertainty is based on a necessary spatial orientation of the toy's plurality of detectors and also on a necessary temporal enablement of a one of the plurality of detectors upon which the signal is incident, simulates the uncertain results of armament fire during combat.

6. A traveling toy responsive to remotely-generated signals of two separate types, the toy comprising:

a toy body;

locomotion means, affixed to the body, for spatially moving and directionally orienting the body in response to signals of a first type which first-type signals are remotely generated from time to time;

directional signal-emitting means, affixed to the body and also responsive to remotely-generated signals of the first type, for directionally emitting a signal of a second type;

selective receiving means, affixed to the body, selectively responsive to receipt of any non-self emitted second-type signals by consequence of (i) being within the directional path thereof, (ii) being properly spatially oriented relative to the directional path, and (iii) being, from time to time and independently of the remote generation of the first signal, enabled for receiving; and indicator means for indicating any such selective receipt of a second-type signal;

wherein (i) a position, (ii) a spatial orientation, and (iii) a time-to-time temporal enablement of the selective receiving means are each necessary in order that a second-type signal should be received and indicated;

wherein because the selective receiving means is affixed to the toy body for spatially moving and directionally orienting therewith in response to the time-to-time remote generation of the first signal, which time-to-time generation is independent of the time-to-time enablement of the selective receiving means;

wherein the independence of the time-to-time generation of the first signal, and the time-to-time enablement of the selective receiving means, imparts a degree of randomness to the indicating.

7. The toy according to claim 6 wherein the receiving means comprises:

an array of directional receiving/means individually responsive to receipt of the non-self-emitted second-type signal by consequence of being in the directional path thereof, (ii) spatially oriented toward a source of this directional second-type signal, and (iii) selectively temporally enabled, for indicating receipt of a second-type signal.

8. The toy according to claim 6 wherein the directional signal-emitting means comprises:

a source of light; and wherein the receiving means comprises:

a sensor of light.

9. The toy according to claim 8 wherein the source of light comprises:

an emitter of light;

a lens for collimating light emitted by the emitter of light; and a tube for directing the collimated a directionally-emitted second-type signal.

10. The toy according to claim 8 wherein the receiving means comprises:

a plurality of directionally-sensitive receiving means that are responsive to receipt of any non-self-emitted second-type signals only as are received from a particular direction relative to the toy body.

11. The toy according to claim 10 wherein at least one of the array of directionally-sensitive receiving means comprises:

a light-sensitive semiconductor device sensitive to light from a source of light impinging thereon and partial obscuring means, affixed to the toy body, for preventing that any light from the source of light save that which is received from the particular direction relative to the toy body should impinge upon the light-sensitive semiconductor device.

12. A full-floating simulated-steering-wheel positional-signal-producing mechanism comprising:

a member suitable to be grasped by a hand so as to be positionally manipulated in all axis, and angularly manipulated in all angles of rotation, while held by the hand free-floating in space, assuming any spatial position or angular rotation whatsoever under force of the hand;

a housing, affixed to the member, defining a cavity therein;

a magnet free to move under force of gravity within the housing's cavity; and an array of plurality of switch means, affixed to the housing in positions arrayed around and proximate to the housing's cavity, each for producing electrical signal selectively upon such times as the moving magnet is proximate thereto while not producing an electrical signal at other times or elsewise;

the electrical signals that are selectively produced by the array of the plurality of switch means constituting, in aggregate, positional signals because such signals are selectively produced responsively to the spatial, and angular, orientation of the housing and its affixed member.

13. The mechanism according to claim 12 wherein the member comprises:

at least an angular portion of a steering wheel.

14. The mechanism according to claim 12 wherein magnet comprises:

a permanent magnet;

and wherein each of the plurality of switch means comprises:

a reed switch.

15. A full-floating simulated-steering-wheel positional-signal-producing mechanism comprising:

a member suitable to be grasped by a hand so as to be positionally manipulated in all axis, and angularly manipulated in all angles of rotation, while held by the hand free-floating in space, assuming any spatial position or angular rotation whatsoever under force of the hand;

a platform, affixed to the member, defining a three-dimensional multi-axis spatial matrix to which things may be affixed;

a plurality of mercury switch means each sensitive in its spatial orientation to either produce, or not produce, a signal and affixed to the platform in positions oppositely arrayed about at least one axis;

the signals that are selectively produced by the array of the plurality of mercury switch means, depending upon the spatial orientation of each, constituting, in aggregate, positional signals because such signals are selectively produced responsively to the spatial, and angular, orientation of the platform and its affixed member.

16. A full-floating positional-signal-producing mechanism comprising:

a member suitable to be grasped by a hand so as to be positionally manipulated in all axis, and angularly manipulated in all angles of rotation, while held by the hand free-floating in space, assuming any spatial position or angular rotation whatsoever under force of the hand;

a platform, affixed to the member, defining a three-dimensional multi-axis spatial matrix to which things may be affixed;

a plurality of mercury switch means each sensitive in its spatial orientation to either produce, or not produce, a signal and affixed to the platform in positions oppositely arrayed about at least one axis;

the signals that are selectively produced by the array of the plurality of mercury switch means, depending upon the spatial orientation of each, constituting, in aggregate, positional signals because such signals are selectively produced responsively to the spatial, and angular, orientation of the platform and its affixed member.

17. A full-floating positional-signal-producing mechanism comprising:

a member suitable to be grasped by a hand so as to be positionally manipulated in all axis, and angularly manipulated in all angles of rotation, while held by the hand free-floating in space, assuming any spatial position or angular rotation whatsoever under force of the hand, the member having and defining a cavity therein;

a magnetic element, considerably smaller than the member and its cavity, having a magnetic reluctance that is considerably different from both free space and from a magnetic reluctance of the member, for moving freely under force of gravity within the housing's cavity; and an array of plurality of switch means, affixed to the housing in positions arrayed around and proximate to the housing's cavity, each sensitive to local changes in local magnetic reluctance for producing an electrical signal selectively upon such times as the moving magnetic element is proximate thereto while not producing an electrical signal at other times or elsewise;

the electrical signals that are selectively produced by the array of the plurality of switch means constituting, in aggregate, positional signals because such signals are selectively produced responsively to the spatial, and angular, orientation of the member.

18. A full-floating positional-signal-producing mechanism comprising:

a member suitable to be grasped by a hand so as to be positionally manipulated in all axis, and angularly manipulated in all angles of rotation, while held by the hand free-floating in space, assuming any spatial position or angular rotation whatsoever under force of the hand, the member having an defining a cavity therein;

a magnetic element, considerably smaller than the member and its cavity, having a magnetic susceptibility that is considerably different from both free space and from a magnetic susceptibility of member, for moving freely under force of gravity within the housing's cavity; and an array of plurality of switch means, affixed to the housing in positions arrayed around and proximate to the housing's cavity, each sensitive to local changes in local magnetic susceptibility for producing an electrical signal selectively upon such times as the moving magnetic element is proximate thereto while not producing an electrical signal at other times or elsewise;

the electrical signals that are selectively produced by the array of the plurality of switch means constituting, in aggregate, positional signals because such signals are selectively produced responsively to the spatial, and angular, orientation of the member.

* * * * *